US005379616A

United States Patent [19]

Bae

[11] Patent Number: 5,379,616

[45] Date of Patent: Jan. 10, 1995

[54] POWER TRANSFER APPARATUS OF FULLY-AUTOMATED WASHING MACHINE

[75] Inventor: Sang-Chul Bae, Kyungki-do, Rep. of Korea

[73] Assignee: Samsung Electronics Co., Ltd., Suwon, Rep. of Korea

[21] Appl. No.: 70,932

[22] Filed: Jun. 4, 1993

[30] Foreign Application Priority Data

Jun. 5, 1992 [KR] Rep. of Korea ..... 92-9750

[51] Int. Cl.[6] ..... D06F 37/40

[52] U.S. Cl. ..... 68/23.7; 74/33

[58] Field of Search ..... 68/23.7; 74/33; 192/17 R

[56] References Cited

U.S. PATENT DOCUMENTS 2,222,329 11/1940 Watts ..... 68/23.7 X
2,816,450 12/1957 Conlee ..... 68/23.7 X
2,826,056 3/1958 Bruckman ..... 68/23.7
3,845,642 11/1974 Cochran ..... 68/23.7
4,254,641 3/1981 Gauer et al. ..... 68/23.7
4,566,295 1/1986 Mason ..... 68/23.7 X

FOREIGN PATENT DOCUMENTS 2-46861 12/1990 Japan .

*Primary Examiner*—Philip R. Coe
*Attorney, Agent, or Firm*—Burns, Doane, Swecker & Mathis

[57] ABSTRACT

A clothes washing machine includes an oscillatory agitator and a rotary spin dry container (tub). The agitator and spin dry container are driven by a drive shaft. The drive shaft rotates only in a first direction during a wash cycle, and only in a second direction during a spin dry cycle. A motion conversion mechanism disposed between the agitator and drive shaft converts the first-direction rotation of the drive shaft into oscillation of the agitator.

8 Claims, 3 Drawing Sheets

POWER TRANSFER APPARATUS OF FULLY-AUTOMATED WASHING MACHINE

BACKGROUND OF THE INVENTION

1. Field of the Invention

The present invention relates to a uni-tub style washing machine (hereinafter referred to as "fully automated washing machine) which can perform both a wash cycle and spin-dry cycle in a wash/spin-dry tub, and more particularly to a power transfer apparatus of a fully automated washing machine which can perform the wash cycle by way of an oscillatory agitator (hereinafter referred to as "washing means") and which can perform the spin-dry cycle by way of a rotation of the wash/spin-dry tub (hereinafter referred to as "spin-dry means").

2. Description of the Prior Art

Generally, various kinds of power transfer apparatuses as driving sources have been proposed for rotating the washing means in forward/reverse directions during the wash cycle and for rotating the spin-dry means during the spin-dry cycle.

Furthermore, as one of the prior art, there has been proposed a power transfer apparatus of fully-automated washing machine in a Japanese Utility Model gazette, application No. Hei 2-46861.

The power transfer apparatus of fully-automated washing machine published in the Japanese gazette comprises, as illustrated in FIG. 1, a dual axle structure supported by bearings 7' and 8' and having a washing output axle 6' connected to a washing means 1 and a spin-dry output axle 5' connected to a spin-dry means 2.

The power transfer apparatus of fully-automated washing machine only rotates the washing output axle 6' clockwise and counter-clockwise during the wash cycle and rotates the spin-dry output axle 5' along with the washing output axle 6' in the same direction by way of a connection with a clutch spring 4' during the spin-dry. That power comprises transfer apparatus one way clutch for transferring the power so that the spin-dry output axis 5' is rotated only in a spin-dry rotating direction and is prevented from rotating in a reverse direction.

The power transfer apparatus of conventional fully-automated washing machine thus constructed performs a washing by way of forward/reverse rotations of the driving source during the washing cycle to thereby rotate the washing means clockwise and counter-clockwise, and performs the spin-dry byway of one way rotation of the driving source during the spin-dry to thereby rotate the washing means and spin-dry means in any one direction simultaneously.

In other words, the power transfer apparatus of conventional fully automated washing machine rotates the driving source in forward/reverse directions during the washing cycle to thereby rotate the washing means so that various problems such as a generation of over-load on the driving source and a shortening of life cycle of the driving source have a risen.

SUMMARY OF THE INVENTION

The present invention has been prepared in consideration of the aforementioned problems, and it is an object of the present invention to provide a power transfer apparatus of fully automated washing machine which can perform the washing even though a driving source rotates only in one direction during a washing to thereby rotate the washing means in forward/reverse directions, and which can perform the spin-dry when the driving source is rotated in another direction to thereby rotate the washing means and spin-dry means in the other direction, so that an over-load on the driving source can be prevented and the life of the driving source can be extended.

In accordance with the object of the present invention, there is provided a power transfer apparatus of fully automated washing machine, the apparatus comprising: a driving source for generating a power; a washing means for washing a laundry by being rotatively driven by the driving source rotating in a first direction; a spin-dry means which is rotatively driven in second direction by the driving source to thereby spin-dry the laundry; and a clutch means which divides the rotational force of the driving source into the washing means and spin-dry means according to the rotational directions. According to the aforesaid construction, even though the driving source is rotated in only one direction during the washing, the washing means is rotated in forward/reverse directions so that the washing can be easily executed, and during the spin-dry, the driving source is rotated in the opposite direction, so that the spin-dry can be performed.

In other words, even though the driving source is not rotated in forward/reverse directions during the washing cycle, the washing means can be rotated in forward-/reverse directions, so that no over-load is generated on the driving source and a life span of the driving source can be increased as well.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
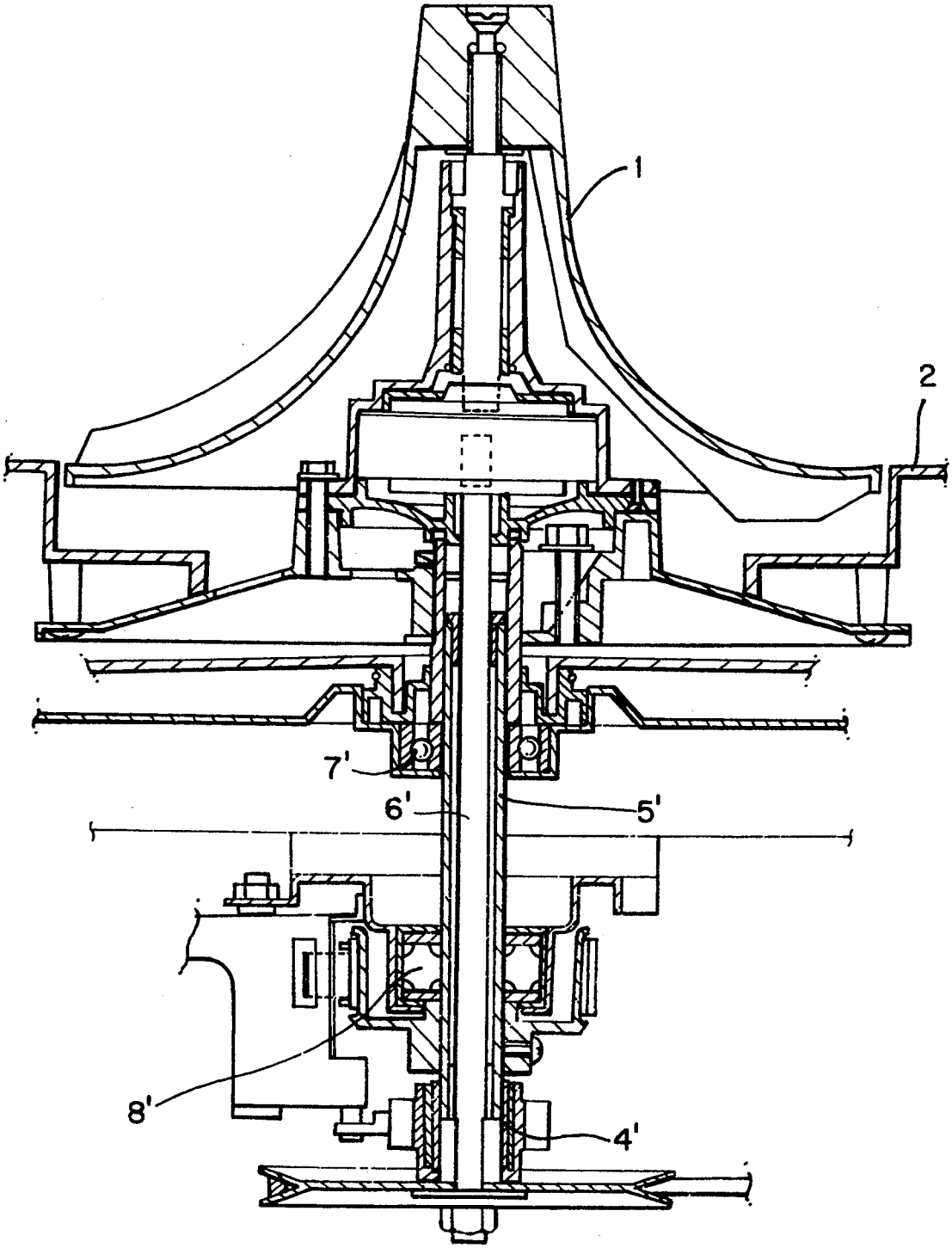
FIG. 1 (PRIOR ART)
FIG. 1 is a sectional drawing for illustrating a power transfer apparatus of a fully-automated washing machine according to the conventional embodiment.
Figure 2:
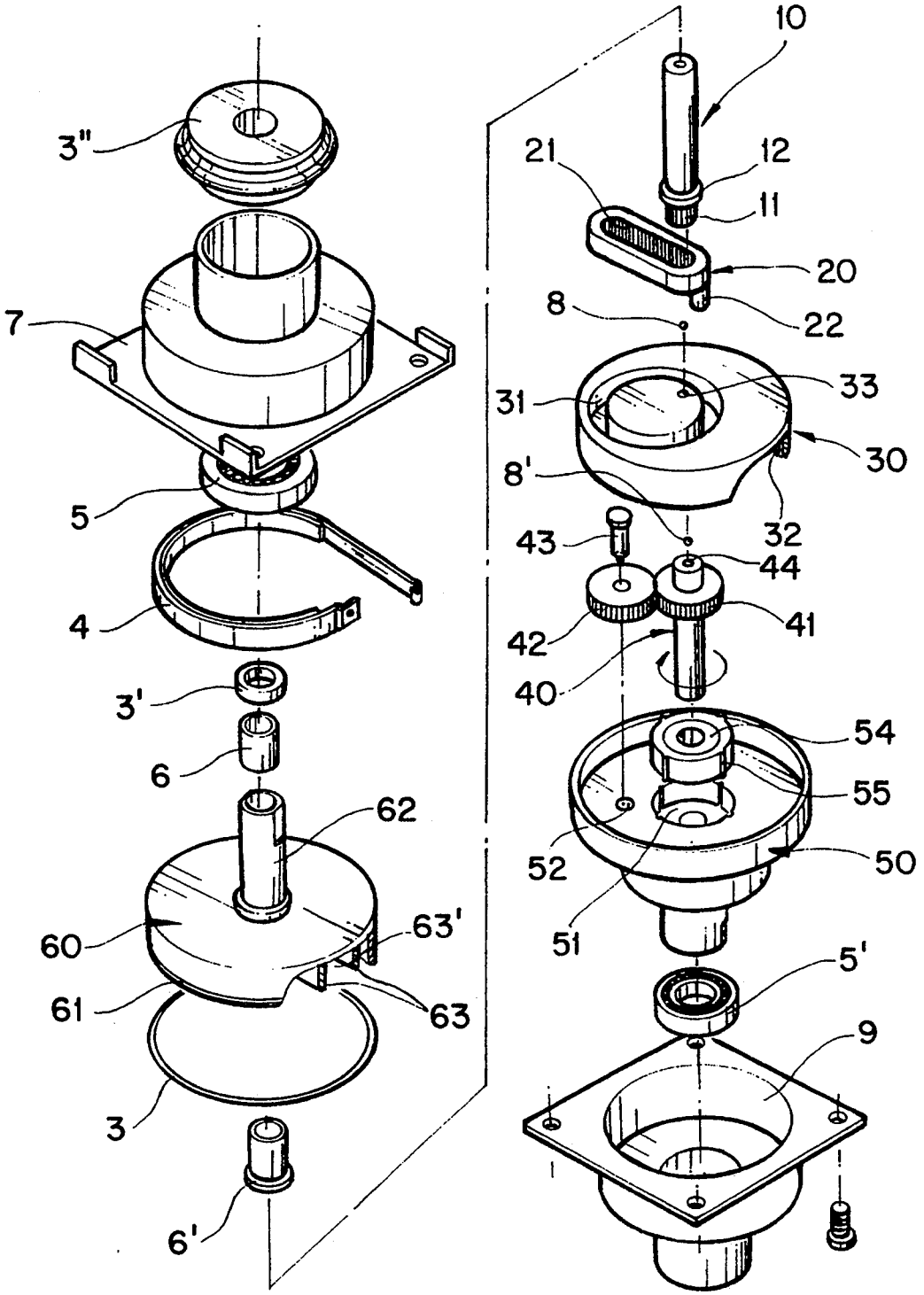
FIG. 2 is an exploded perspective view illustrating a power transfer apparatus of a fully-automated washing machine fragmented in accordance with the present invention.
Figure 3:
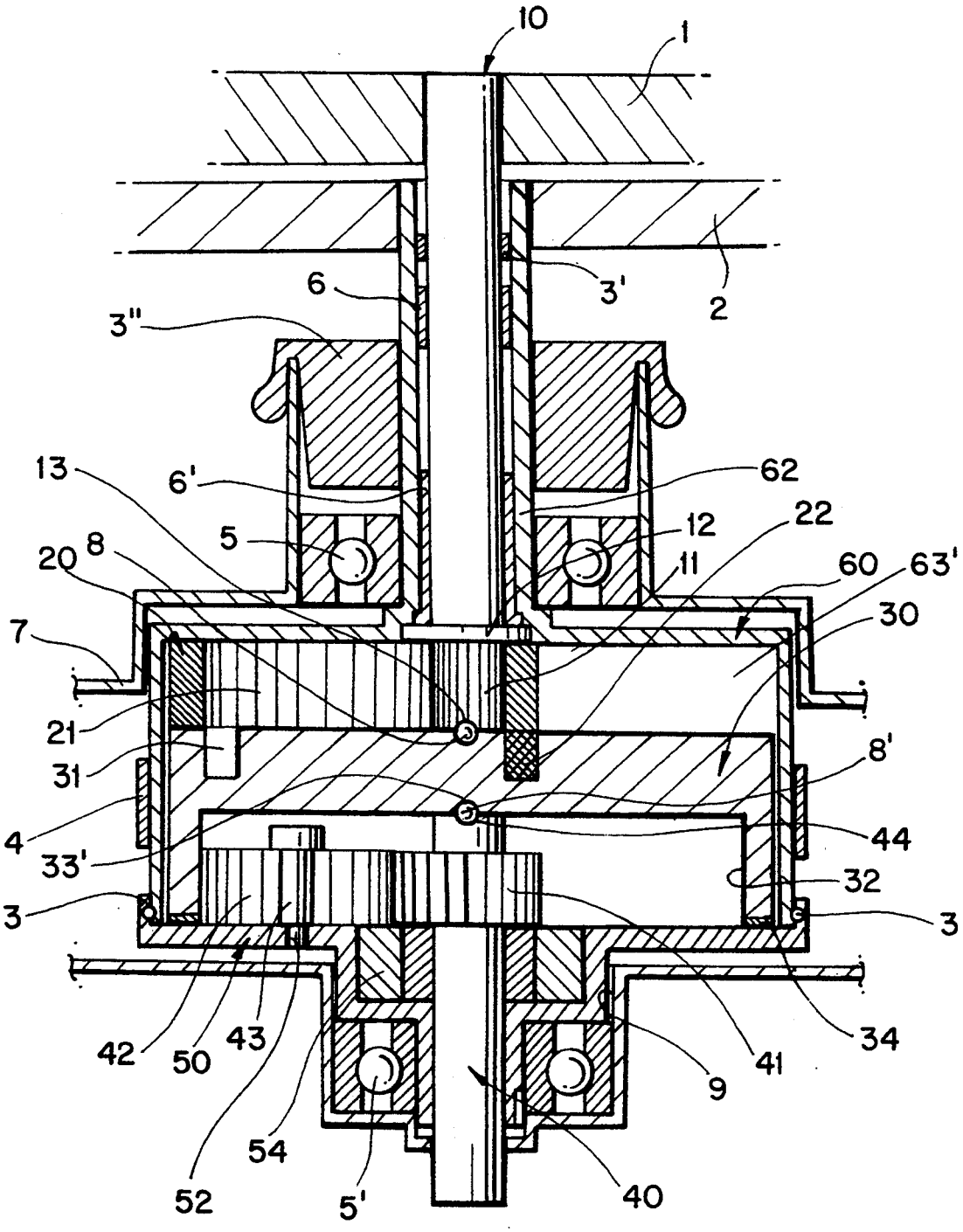
FIG. 3 is a sectional drawing for illustrating an inner structure of the power transfer apparatus of a fully-automated washing machine in accordance with the present invention.

In FIGS. 2 and 3, a reference numeral 10 is a driven shaft for rotating the washing means 1 of the fully automated washing machine in forward/reverse directions by being connected to the washing means 1, wherein a gear 11 is formed on the shaft and is engaged with a rack gear of a rack means 20 (explained later) on a peripheral surface of a lower area and a protruder flange 12 is formed on an upper area of the gear 11.

Furthermore, a concave groove 13 is formed on a center of the lower end face of the driven shaft 10, so that the same can receive a ball bearing (to be explained).

The rack means 20 has a rack gear unit 21 meshed with the gear 11 formed on the driven shaft 10.

The rack means 20 is ostensibly in the shape of an oval in which the rack gear 21 is formed and carries on its lower surface a roller member 22 housed into a guide unit 31 of a conversion means 30 (to be explained).

In other words, the rack means 20 is rectilinearly reciprocated by the conversion means 30 (to be explained) during the wash cycle to thereby oscillate the driven shaft 10 in the forward/reverse directions, so that the washing means 1 can be rotated in the forward-/reverse directions. During the spin-dry cycle, the rack means 20 is interlocked to a transfer case member 60 (to be explained) to be thereby.

The conversion means 30 for guiding the rack means 20 to be rectilinearly reciprocated during the wash cycle is disposed below the rack means 20.

In other words, the conversion means is rotated by a rotation of a driving shaft (to be explined) and that motion into a rectilinearly reciprocating motion of the rack means 20.

The conversion means 30 housing the roller member 22 on the upper area is formed with the guide unit 31 for guiding the rack means to rectilinearly reciprocate, and on an internal surface of the conversion means there is formed a gear unit 32 meshed with a transfer gear 42 (to be explained).

In other words, the guide unit 31 comprises a track whose axis is cocentric relative to the axis of the conversion means 30, and the roller member 22 is housed in the track, so that when the conversion means 30 is rotated, the rack means 20 can be rectilinearly reciprocated.

Furtheremore, concave grooves 33 and 33' are respectively formed on an approximate center of the upper and lower faces of the conversion means 30, and a ball bearing 8 is inserted into the concave groove 33.

The upper area of the ball bearing 8 projects into a concave groove 13 formed on the driven shaft 10, so that the driven shaft can be positioned thereon. So, the conversion means 30 can be smoothly rotated in one direction while oscillating the driven shaft 10.

The inscribed gear unit 32 of the conversion means 30 is meshed with a transfer gear 42, the latter being rotatably mounted to a gear case 50 by a shaft 43.

A driving shaft 40 is rotated by a driving motor and a driving gear unit 41 formed on an upper end thereof is meshed with the transfer gear 42.

Furthermore, on the center of the upper area of the driving shaft 40 there is formed a concave groove 44, into which a ball bearing 8' is inserted.

That ball bearing 8' projects into the concave groove 33' so that the conversion means can be positioned thereon.

In other words, the conversion means 30 is rotatably mounted on the shaft 40 by the ball hearing 8'.

Furthermore, the driving shaft 40 is partially inserted into the gear case 50, as illustrated in FIG. 3, so that the lower end thereof can be protruded from the gear case 50 to thereby receive a power from the driving source.

The gear case 50 is formed with a groove 51 on the center of the upper area, its upper area, and is also formed with a shaft cavity 52 for receiving the shaft 43.

In the semi-circular groove 51, a clutch means is housed the clutch means includes semi-circular protrusions 55 for transferring a rotation of the driving shaft 40 to the gear case 50 during the spin-dry cycle (the gear case 50 being held against rotation by a brake band 4 during the wash cycle).

In other words, into the inner diameter of the clutch means 54, the driving shaft is inserted and part of the driving shaft 40 is protruded from the gear case 50 to thereby receive the power of the driving source.

Furthermore, the transfer gear 42 is disposed on the upper area of the shaft cavity 52 of the gear case 50.

When the driving shaft 40 is rotated, the driving gear unit 41 of the driving shaft 40 rotates the transfer gear 42 smoothly without any sway.

An oilless bearing 34 is disposed, as illustrated in FIG. 3, between the lower area of the conversion means 30 and upper area of the gear case 50, so that the conversion means 30 can be smoothly rotated during the wash cycle and the gear case 50 is smoothly rotated during the spin-dry cycle.

A transfer case member 60 is coupled with the gear case 50 after the driving shaft 40, the conversion means 30 and rack means 20 are disposed on the upper area of the gear case 50.

The transfer case member 60 is formed in a cylindrical shape and on a top area thereof is formed a protruding shaft 62 which is coupled with a spin-dry means 2 and on an external periphery thereof is formed a groove 61. The protruding shaft 62 is formed with a cavity into which the driven shaft 10 is inserted into the shaft 62.

In other words, the transfer case member 60, after the driving shaft 40, conversion means 30 and rack means are disposed on the gear case member 50, is bolted to the gear case member 50 with part of the driven shaft 10 protrudingly inserted from the protruding shaft 62.

Furthermore, before the transfer case member 60 and gear case member 50 are coupled, an oil sealing member 3 is received in the groove 61, so that the inside space formed by the transfer case member 60 and gear case member 50 is airtight.

Metal members 6 and 6' are respectively inserted in the upper and lower portions of a gap formed between the protruding shaft 62 and the driven shaft 10 so that the driven shaft 10 can be smoothly rotated during the wash cycle and the transfer case member 60 can be smoothly rotated during the spin-dry cycle.

An oil sealing member 3' is inserted into that gap so that water can not be inflowed into an inner spacing formed by the transfer case member 60 and the gear case member 50.

A band brake 4 is equipped on a periphery of the transfer case member 60 in order to hold the transfer case member 60 against rotation during the wash cycle.

A pair of guide flanges is positioned in the inner area of the transfer case member 60 as illustrated in FIG. 2, to form a guide channel 63' in which the rack is guided for reciprocation during the wash cycle. The guide channel 63' also serves to lock the rack for rotation with the transfer case member 60 during the spin-dry cycle.

Meanwhile, in the drawing, a reference numeral 7 is an upper case, and 9 is a lower case coupled by the upper case 7 by a bolt. A bearing member 5 is disposed in an inner area of the upper case 7 so that the transfer case member 60 is smoothly rotated during the spin-dry cycle. An oil sealing member 3'' is disposed on the upper area of the upper case 7 in order to keep the bearing member 5 airtight.

It is apparent that a bearing member 5' is also disposed in an inner area of the lower case 9, so that the gear case 50 can be smoothly rotated.

According to the power transfer apparatus thus constructed in accordance with the present invention, the driving shaft 40 and driving source are rotated in a first direction when the driving source is rotated only in one direction during the washing cycle.

At this moment, the transfer case member 60 is prevented from rotating by the band brake 4 so that the spin-dry means 2 is not rotated.

Furthermore, as the driving shaft 40 is rotated in the first direction, the driving gear unit 41 of the driving shaft 40 and meshed transfer gear 42 are also rotated in one direction.

As the transfer gear 42 is rotated in one direction, the transfer gear 42 and meshed conversion means 30 are rotated.

As the conversion means 30 is rotated in one direction the roller member 22 of the rack means 20 is guided in the guide unit 31, so that the rack means 20 can perform a rectilinear reciprocating motion.

At this point, the rack means 20 is guided in the guide channel 63 formed on the transfer case member 60 to thereby perform a rectilinear reciprocating motion without any sway. The guide channel 63' is formed by a pair of parallel plates 63.

In other words, the rack means 20 is driven in a rectilinear reciprocating motion by the conversion means 30.

Likewise, according as the rack means 20 performs the rectilinear reciprocating motion, the meshed driven shaft 10 is rotated in forward/reverse directions, and the washing means 1 fixed to the driven shaft 10 is rotated in forward/reverse directions.

In other words, even though the driving source is rotated only in one direction during the washing, the driven shaft 10 is rotated in forward/reverse directions, so that the washing means 1 coupled to the driven shaft 10 can be rotated in forward/reverse directions to thereby perform the washing smoothly.

Meanwhile, the brake means (not shown) slacks the band brake 4 during the spin-drying to thereby maintain a state under which the transfer case member 60 can be rotated, so that the driving source can be rotated in a second direction opposite the first direction.

Furthermore, when the driving source is rotated in the second direction, the driving shaft 40 is also rotated in the second direction.

At this point, the clutch means 54 housed in the gear case 50 is also rotated in the second direction, and the gear case 50 is rotated in the second direction by the semi-circular protruder protrusions 55 of the clutch means 54.

Furthermore, as the gear case 50 is rotated in the second direction, the transfer case member 60 coupled by bolt to the gear case is also rotated in the second direction As the transfer case member 60 is rotated, the rack means 20 housed in the guide member 63 formed in the transfer case member 60 is interlocked with the transfer case member 60 to thereby be rotated therewith.

In other words, as the gear case is rotated in the second direction to thereby make the transfer case member 60 rotate in the second direction, the spin-dry means 2 and wash means 1 coupled to the protruding shaft 62 of the transfer case member 60 are rotated in the second direction to thereby perform a spin-dry operation smoothly.

As seen from the foregoing, according to the power transfer apparatus of a fully-automated washing machine in accordance with the present invention, the wash means is rotated in the forward/reverse directions to thereby perform the washing smoothly, even though the driving source is rotated only in a first direction during the washing, and during the spin-drying the driving source is rotated in the a second direction to thereby rotate the washing means and spin-drying means in the second direction, so a smooth spin-dry operation can be performed.

In other words, even though the driving source is not rotated in the forward/reverse directions during the wash cycle, the washing means is oscillated to thereby prevent the driving source from being incurred with an over-load and to increase the life of the driving source as well.

What is claimed is:

1. A power transfer apparatus of a clothes washing machine comprised of an oscillatable washing agitator having a driven shaft, and a rotatable spin dry container, said power transfer apparatus comprising:

a vertical drive shaft rotatable about a vertical axis in first and second directions; and a connecting mechanism connecting said drive shaft to said agitator and to said spin dry container for oscillating said agitator in said first and second directions in response to rotation of said drive shaft in said first direction while keeping said spin-dry container stationary, and for rotating said agitator and said spin dry container together in said second direction in response to rotation of said drive shaft in said second direction;

said connecting mechanism comprising:

a case disposed adjacent an upper end of said drive shaft and connected fixedly to said spin dry container for rotation therewith about said axis, a clutch disposed adjacent an upper end of said drive shaft for transmitting rotation from said drive shaft to said case in response to rotation of said drive shaft in said second direction for rotating said case and said spin dry container; a conversion member mounted within said case and being rotatable relative to said case about said axis, a gear arrangement interconnecting said drive shaft and said conversion member for transmitting rotation therebetween, a rack mounted in said case for rotation therewith about said axis and for horizontal reciprocation relative to said case, said rack having teeth connected to said driven shaft for oscillating said driven shaft about said axis in response to reciprocation of said rack relative to said case, said rack carrying a pin mounted in an endless eccentric track carried by said conversion member for producing reciprocation of said track in response to rotation of said conversion member about said axis;

a connecting element interconnecting said conversion member and said rack for reciprocating said rack in response to rotation of said conversion member relative to said case about said axis, and a brake band being engageable with an outer periphery of said case for preventing rotation of said case when said drive shaft is rotated in said first direction and being releasable for permitting rotation of said case when said drive shaft is rotated in said second direction.

2. A power transfer apparatus of a clothes washing machine comprised of an oscillatable washing agitator and a rotatable spin dry container, said power transfer apparatus comprising:

a drive shaft rotatable in first and second directions; and connecting means connecting said drive shaft to said agitator and to said spin dry container for oscillating said agitator in said first and second directions in response to rotation of said drive shaft in said first direction while keeping said spin-dry container stationary, and for rotating said agitator and said spin dry container together in said second direction in response to rotation of said drive shaft in said second direction;

said connecting means including a reciprocal rack means driven by said drive shaft for converting rotational motion of said drive shaft in said first direction into oscillatory motion of said agitator, a first driven shaft coupled to said agitator for rotation therewith and carrying gear teeth, said reciprocal rack means including internal rack teeth in mesh with said gear teeth so that said first driven shaft is rotated in response to reciprocation of said reciprocal rack means, and coupling means coupling said reciprocal rack member to said drive shaft to produce reciprocation thereof in response to rotation of said drive shaft in said first direction, said coupling means comprising a pin carried by said reciprocal rack member and received in an endless eccentric track arranged to be rotated by said drive shaft.

3. A power transfer apparatus according to claim 2 including a case which said reciprocal rack means is mounted for common rotation therewith and for reciprocation relative thereto, said case being connected to said spin dry container for rotation therewith, releasable brake means for selectively holding said case against rotation when said drive shaft is rotated in said second direction, a conversion member mounted in said case and carrying said eccentric track, said conversion member being coupled to said drive shaft to be rotated thereby.

4. A power transfer apparatus according to claim 3 including a gear rotatably mounted to said case and arranged to be driven by gear teeth on said drive shaft, said gear meshing with internal gearing of said conversion member to drive the latter.

5. A power transfer apparatus according to claim 4 including a clutch interconnecting said drive shaft and said conversion member for permitting said drive shaft to rotate relative to said conversion member in said second direction.

6. A power transmission apparatus according to claim 4, wherein said first driven shaft, said case, said drive shaft, and said conversion member are rotatable about a common axis.

7. A power transmission apparatus according to claim 6 including a first ball bearing disposed between said first driven shaft and said conversion member, and a second ball bearing disposed between said conversion member and said drive shaft for rotatably supporting said conversion member for rotation relative to said first driven shaft and said drive shaft, said common axis intersecting both of said first and second ball bearings.

8. A power transmission apparatus according to claim 3 including bearing means disposed between said conversion member and said case to permit smooth relative rotation therebetween.

* * * * *